US006168479B1

(12) United States Patent
Canault et al.

(10) Patent No.: US 6,168,479 B1
(45) Date of Patent: Jan. 2, 2001

(54) CONNECTION DEVICE WITH AN ELASTIC CAGE

(75) Inventors: Jean Canault, Orbaux; Santos Guinda, Guichainville, both of (FR)

(73) Assignee: Schneider Electric SA, Boulogne Billancourt (FR)

( * ) Notice: Under 35 U.S.C. 154(b), the term of this patent shall be extended for 0 days.

(21) Appl. No.: 09/221,117

(22) Filed: Dec. 28, 1998

(30) Foreign Application Priority Data

Dec. 29, 1997 (FR) ..... 97 16846

(51) Int. Cl.[7] ..... H01R 4/24
(52) U.S. Cl. ..... 439/835; 439/725; 439/786
(58) Field of Search ..... 439/346, 347, 439/102, 180, 369, 370, 835, 826, 828

(56) References Cited

FOREIGN PATENT DOCUMENTS 39 11 459 A1 10/1990 (DE) .
94 14 939 3/1995 (DE) .
44 35 781 A1 4/1996 (DE) .

*Primary Examiner*—Paula Bradley
*Assistant Examiner*—Alexander Gilman
(74) *Attorney, Agent, or Firm*—Oblon, Spivak, McClelland, Maier & Neustadt, P.C.

(57) ABSTRACT

A terminal connection device having an elastic cage 10 with a clamping aperture 13 for a cable C, a conducting component 20 which is provided to carry the cage.

An insulating block D linked to the elastic cage carries, on the one hand an arm 31 for opening the cage and on the other hand a conducting connection arm 32, the arms being fitted in such a way that when the block is at the side of the cage, the opening arm 31 bends the loop to allow the connection arm to be introduced into the clamping aperture and to remain pressed against the conducting component.

12 Claims, 2 Drawing Sheets

CONNECTION DEVICE WITH AN ELASTIC CAGE

This invention relates to a connection device which comprises at least one terminal of the type having an elastic cage and a current conducting component, the latter providing the support function for the cage.

Connection devices of this type are well known. They are associated with an apparatus or electrical device and allow a cable which is to be connected to the apparatus or device to be clamped in a terminal without a clamping screw having to be used. In the usual manner, the elastic cage is positioned close to one end of the supporting component close to an access face of the apparatus and comprises a supporting wing applied onto the supporting component, a clamping wing fitted with an aperture for clamping the conductor by a jamming effect and a loop that links the supporting wing to the clamping wing and which forms a spring to ensure that the conductor is jammed in place.

In certain electrical equipment that include such elastic connection terminals, it is desirable to be able to establish a connection, not only with cables which are detachable and held by being jammed, but also with feeder bars or with other items of equipment that are arranged laterally or are superimposed, while benefiting from the presence of these terminals.

Hence an aim of the invention is to make use of elastic cage terminals provided in an electrical apparatus to provide the connection of a cable so as to create a simple and reliable connection with another piece of equipment or with a current conducting device.

According to the invention, the connection device has an insulating block which carries on the one hand an arm suitable for ensuring the opening of the elastic cage and on the other hand a conducting connection arm, the two arms being guided in a way substantially parallel to the supporting wing of the cage and constructed in such a way that, when the block comes alongside the cage, the opening arm bends the loop to allow the connection arm to be introduced into the clamping aperture.

Preferably, the two arms are rigid and a space remains in the clamped position between the opening arm and its housing in the direction in which the elastic loop slackens, in such a way that the application pressure of the connection arm on the conducting component is due to the pressure exerted by the loop on the opening arm. One of the arms can be provided with a shape that assists the retention of the block in the connected position. The insulating block has, on the other hand, at least one interconnecting element such as a conducting pin parallel to the connection arm and connected to it to provide the connection with another apparatus.

One non-limitative embodiment of the invention is described below making reference to the appended drawings.

FIG. 1 diagrammatically represents a connection device conforming to the invention.

Figure 1:
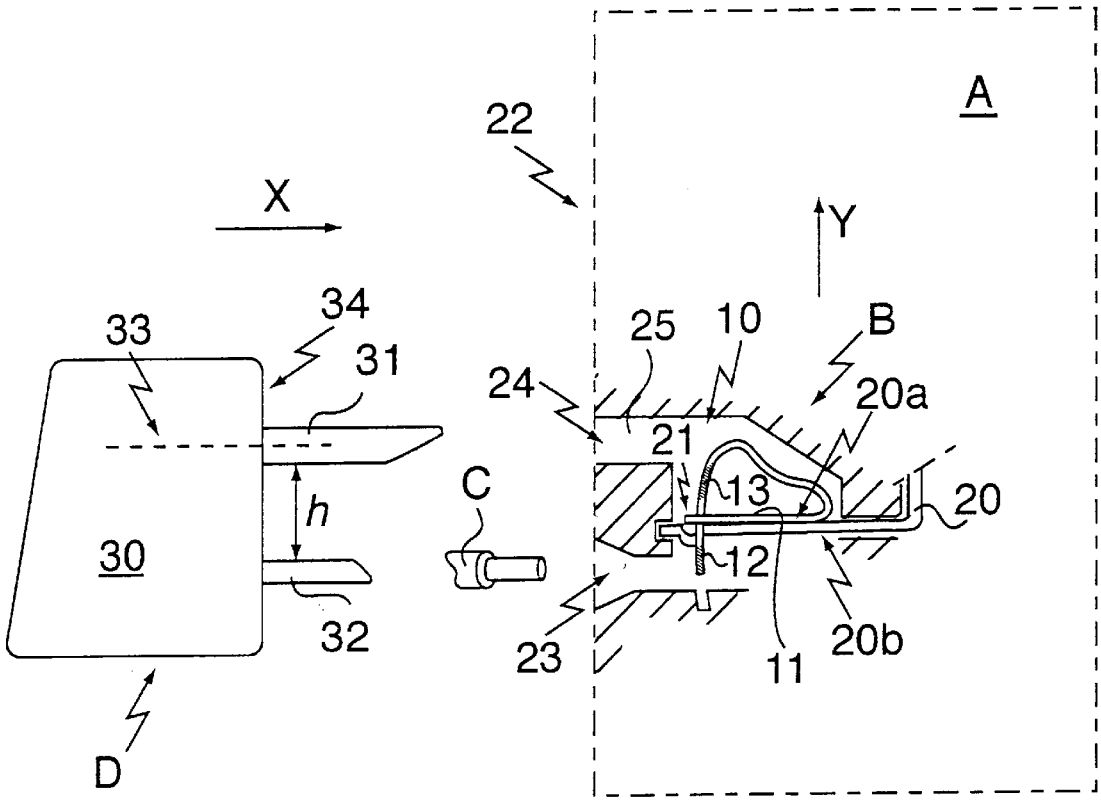

The electrical apparatus A, the outline of which is shown in broken lines is low voltage electrical equipment with a distribution, command or protection function. The apparatus A includes several elastic type connection terminals B capable of receiving and connecting the ends of conductors C. The device according to the invention comprises the terminals B as well as a multipolar connection block D; it being understood that block D could also be unipolar.

Each terminal B comprises an elastic cage 10 and a flat and elongated component 20 which provides the current conduction and the cage support function. The elastic cage 10 is positioned on the front face 20*a* of the support component 20 close to one end 21 of it close to an access sidewall 22 of the apparatus and comprises a supporting wing 11 applied onto the support component over the length of it, a clamping wing 12 fitted with a aperture 13 for clamping a conductor by a jamming effect and a loop 14 which forms a spring and which links the support wing 11 to the clamping wing 12. The back face 20*b* of the component 20 is used to make contact with the cable C and has a U-bend 20*c* for this purpose.

In the usual way, the apparatus includes, for each terminal B, an opening 23 in its access sidewall 22, for the introduction of the cable C to be connected to the component 20 and an opening 24 which is used to engage a tool; as is known, this tool must be capable of pressing on the loop in order to release the terminal, while allowing the aperture 13 to be cleared for the introduction or the release of the cable. It should be noted that the support component 20, the support wing 11 of the elastic cage 10, the openings 23, 24 of the terminal are directed along one and the same direction X which is also the direction for the introduction of cable C. The direction Y for the slackening of the loop 14 and for the displacement of the wing 12 is substantially perpendicular to X. The opening 24 gives access to a housing 25 contiguous with that of the cage 10 so that the tool can work within this housing so as to press on the loop 14 in the direction opposite to Y while being pressed against the external edge 24*a* of opening 24.

Block D has an insulating body 30 which carries on the one hand an arm 31 for opening the cage and on the other hand a conducting connection arm 32. The two arms 31, 32 are directed in a manner substantially parallel to the support wing 11 of the cage 10 along X and are so fitted that when the body 30 comes alongside the apparatus A, the opening arm 31 bends the loop 14 (see the broken lines in FIG. 3) in order to allow the introduction of the connection arm 32 into the aperture 13.

Figure 2:
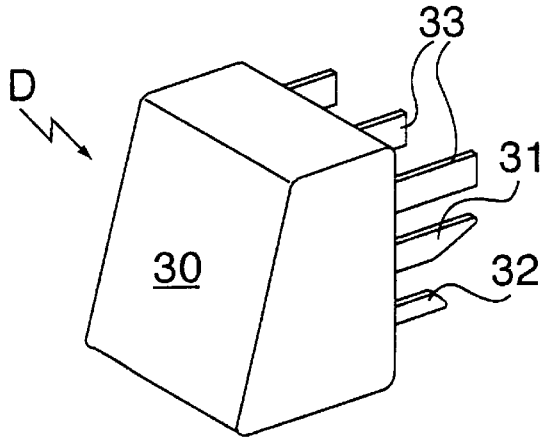
FIG. 2 shows in perspective, a particular embodiment of the connection block of the device.
Figure 3:
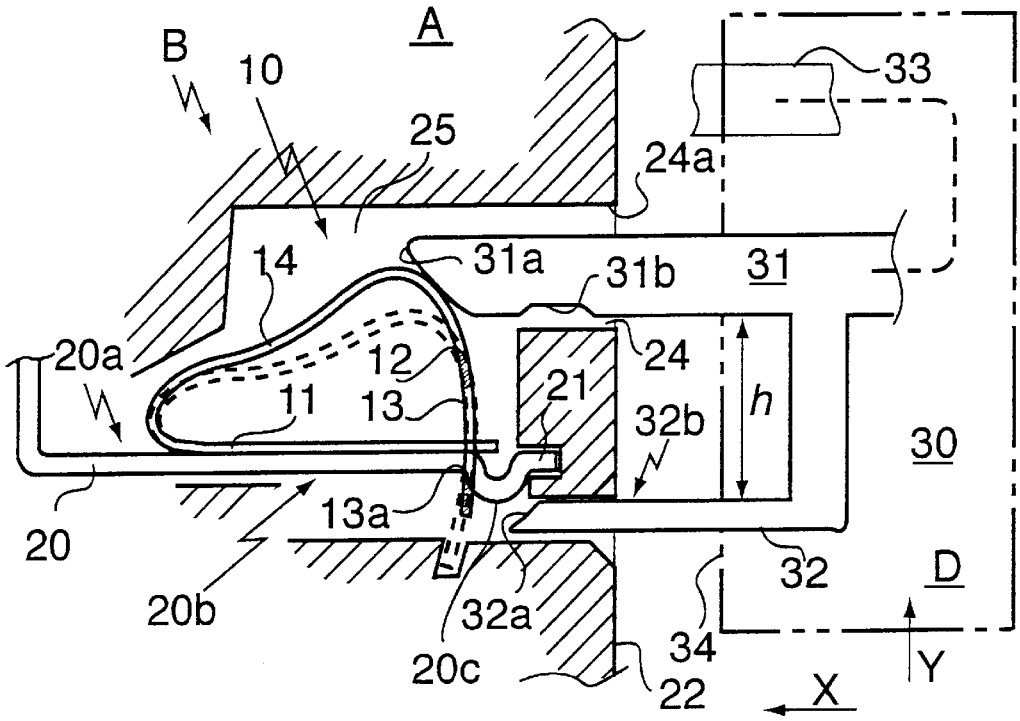
FIGS. 3 and 4 illustrate the device respectively alongside and in the connected condition.
Figure 4:
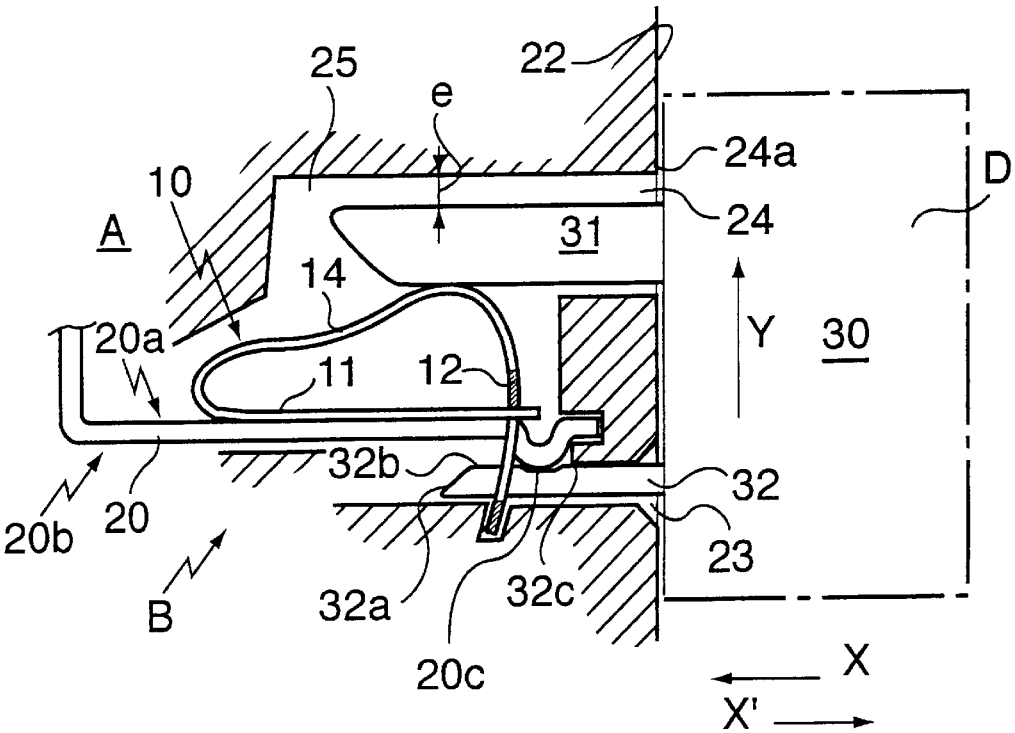

It should be noted that the two arms provide a predetermined gap h between one another and are rigid in such a way that the contact pressure of the connection arm 32 on the conducting component 20 is due to the pressure exerted by the loop 14 on the opening arm 31. To this end, in the position where the arm 32 of the block is clamped against the reverse side 20*b* of the component 20 of the terminal, there remains a space e between the arm 31_and the adjacent surfaces of the opening 24, in particular at its external edge 24*a*. In this way of implementing the invention, the two arms 31, 32 are made of metal and are linked to one another in a rigid manner; the arm 31 can also be made of an insulating material and is possibly made with the body 30 as one component. The connection arm 32 provides the desirable connection for current to pass between the component 20 and another device or apparatus; it can be linked within the body 30 to another plug or pin 33 (see FIG. 2) which establishes a connection with another adjacent apparatus or with a power supply device. The arm 31 has a slope 31*a* in order that it comes progressively alongside the loop 14 and, if the need arises, can have an anti-extraction shape, for example and as is shown in FIG. 3, it can have a recess 31*b* which co-operates with the loop or a friction point provided in the surface of the housing 25 to assist in the holding of block D in the connected and assembled position on apparatus A. The arm 32 has a slope 32*a* in order to slide on the U-bend 20*c* provided at the end 21 of component 20 and it is capable of being applied against the U-bend by its edge 32*b* situated on the arm 31 side. The arm 32 can also have an anti-extraction shape 32*c* as shown in FIG. 4. The arms 31, 32 have any appropriate shape, arm 31 being, for example, a flat pin and arm 32 a round pin.

The operation of the device will now be described making reference to FIGS. 3 and 4.

The user brings the insulating block D of the apparatus along direction X. At the same time that he introduces for each pole, the pin 33 is inserted into a terminal or a connection device (not shown) of another apparatus or conducting device, it causes the opening arm 31 of block D to pass into the opening 24 of the terminal B of the apparatus A; the slope 31*a* of the arm 31 is applied to the front rounded part of the loop 14 in such a way that the loop bends; the connection arm 12 of the cage 10 comes to the position shown in broken lines in FIG. 3 in order to make the aperture 13 accessible.

Continuation of the movement forward of block D brings about the introduction of arm 32 into the aperture 13 and causes it to pass alongside the U-bend 20*c* of component 20, while the arm 31 continues to slide over the summit of the loop until it is brought into abutment with an element of block D, for example, the front face 34 of block D against the surface 22 of the apparatus. It can be observed that the clamping edge 13*a* of the aperture 13, that is active in the clamping of cable C, remains inactive in relation to the connection arm 32. The arm 32 is held against the conducting component 20 by the force of reaction of the elastic cage 10 exerted along direction Y and transmitted by the rigid arm 31 and the body 30 of block D. It will be noted that the block is retained against extraction in direction X' by co-operation of the recess 31*b* of the arm 31 with the loop 14 or with a friction point provided on the surface of the housing 25 or by co-operation of the recess 32*c* of the arm 32 with the U-bend 20*c* of the conduction component 20. Furthermore, a means of locking or snapping the block onto the apparatus may be provided.

What is claimed is:

1. A connection device comprising:

at least one terminal having an elastic cage and a conducting support component, the elastic cage being positioned close to one end of the support component, the elastic cage including a support wing attached to the support component, a clamping wing having an aperture configured to clamp a conducting connection arm by a jamming effect, and a loop forming a spring and linking the support wing to the clamping wing; and an insulating block having an opening arm configured to open the elastic cage, and the conducting connection arm, wherein the two arms are configured to extend in a direction substantially parallel to the support wing of the elastic cage when the insulating block is positioned alongside the elastic cage such that the opening arm bends the loop to allow the introduction of the conducting connection arm into the clamping aperture.

2. A device according to claim 1, characterised by the fact that the opening arm has a shape that cooperates with the loop in order to assist in keeping the insulating block connected.

3. A device according to claim 1, characterised by the fact that the conducting connection arm has a shape that cooperates with a U-bend of the conducting support component in order to assist in keeping the insulating block connected.

4. A device according to claim 1, characterised by the fact that the insulating block has at least one conducting pin for interconnection that is parallel to the conducting connection arm and linked within a body to the conducting connection arm.

5. A device according to claim 1, characterised by the fact that the two arms are rigid and that a space remains in the clamped position between the opening arm and a housing thereof, in such a way that a contact pressure of the conducting connection arm on the conducting support component is due to pressure exerted by the loop on the opening arm.

6. A device according to claim 5, characterised by the fact that the two arms are made of metal and linked to one another in a rigid manner.

7. A connection device comprising:

at least one terminal having a cage and a conducting support component, the cage having a support wing attached to the conducting support component, a clamping wing having an aperture configured to receive and clamp a conducting connection arm, and a loop configured to form a spring and link the support wing to the clamping wing; and an insulating block having the conducting connection arm, and an opening arm configured to be received within the cage, wherein the connection device is configured such that when the at least one terminal is joined with the insulating block the opening arm contacts and bends the loop to a position such that the conducting connection arm can be inserted within the aperture in the clamping wing and connected to the conducting support component.

8. A device according to claim 7, wherein:

the conducting connection arm and the opening arm are rigid; and the opening arm has a clamped position such that a space remains in the clamped position between the opening arm and a housing thereof, in such a way that a contact pressure of the conducting connection arm on the conducting support component is due to pressure exerted by the loop on the opening arm.

9. A device according to claim 7, wherein the conducting connection arm and the opening arm are made of metal and linked to one another in a rigid manner.

10. A device according to claim 7, wherein the opening arm has a recess that cooperates with the loop in order to assist in keeping the conducting support component connected to the conducting connection arm.

11. A device according to claim 7, wherein the conducting connection arm has a recess that cooperates with a bend of the conducting support component in order to assist in keeping the conducting support component connected to the conducting connection arm.

12. A device according to claim 7, wherein the insulating block has at least one conducting pin for interconnection that is parallel to the conducting connection arm and linked within a body to the conducting connection arm.

* * * * *

UNITED STATES PATENT AND TRADEMARK OFFICE

CERTIFICATE OF CORRECTION

PATENT NO. : 6,168,479

DATED : January 2, 2001

INVENTOR(S): Jean Canault, et al.

It is certified that an error appears in the above-identified patent and that said Letters Patent is hereby corrected as shown below:

On the title page, Item [75], the 1st Inventor's city of residence is spelled incorrectly. Item [75] should read as follows:

[75] Inventors: Jean Canault, Orvaux; Santos Guinda, Guichainville, both of (FR)

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*